US011219573B2

(12) United States Patent
Lu

(10) Patent No.: US 11,219,573 B2
(45) Date of Patent: Jan. 11, 2022

(54) FULLY FOLDABLE FOUR-WHEEL WALKING AID

(71) Applicant: Foshan HCT Medical Equipment Co., Ltd., Foshan (CN)

(72) Inventor: Yonghua Lu, Shangrao (CN)

(73) Assignee: Foshen HCT Medical Equipment Co., Ltd., Foshan (CN)

( * ) Notice: Subject to any disclaimer, the term of this patent is extended or adjusted under 35 U.S.C. 154(b) by 0 days.

(21) Appl. No.: 16/903,416

(22) Filed: Jun. 17, 2020

(65) Prior Publication Data

US 2020/0352816 A1 Nov. 12, 2020

(51) Int. Cl.
*A61H 3/04* (2006.01)
*A61H 3/00* (2006.01)

(52) U.S. Cl.
CPC ..... *A61H 3/04* (2013.01); *A61H 2003/002* (2013.01); *A61H 2003/046* (2013.01); *A61H 2201/0149* (2013.01); *A61H 2201/0161* (2013.01); *A61H 2201/1635* (2013.01)

(58) Field of Classification Search
CPC ..... A61H 3/04; A61H 2003/046
See application file for complete search history.

(56) References Cited

U.S. PATENT DOCUMENTS 5,538,268 A * 7/1996 Miller ..... A61H 3/04 280/87.041
7,559,560 B2 * 7/2009 Li ..... A61H 3/04 16/35 R
7,837,208 B2 * 11/2010 Willis ..... A61H 3/04 280/87.021
8,434,780 B2 * 5/2013 Li ..... A61H 3/04 280/639
8,708,363 B1 * 4/2014 Chang ..... A61H 3/04 280/642
9,241,864 B2 * 1/2016 Miller ..... A61H 3/04
9,254,236 B2 * 2/2016 Nicholson ..... A61H 3/00
9,381,132 B2 * 7/2016 Chen ..... A61H 3/04
9,687,411 B2 * 6/2017 Chen ..... A61H 3/04
9,763,849 B2 * 9/2017 Paterson ..... A61H 3/04
9,839,571 B2 * 12/2017 Pan ..... A61H 3/04
9,877,889 B2 * 1/2018 Chen ..... A61H 3/00
(Continued)

FOREIGN PATENT DOCUMENTS

EP 3095431 A1 * 11/2016 ..... A61H 3/04

*Primary Examiner* — David R Dunn
*Assistant Examiner* — Danielle Jackson

(57) ABSTRACT

The present invention discloses a fully foldable four-wheel walking aid, comprising a left frame and a right frame which are connected by an X-shaped frame, wherein each of the left frame and the right frame includes a wheel frame, an armrest adjustment frame, a fixed base and a rotary movable base. The armrest adjustment frame, the rotary movable base and the fixed base are connected by a rotating shaft screw; and a through hole of armrest adjustment frame is provided in the armrest adjustment frame, rotary movable base is provided with a through hole of rotary movable base, and fixed base is provided with a through hole of fixed base. An open space is formed by the through hole of armrest adjustment frame, the through hole of rotary movable base and the through hole of fixed base, and an elastic pin having recovery capability is provided in the open space.

10 Claims, 8 Drawing Sheets

(56) References Cited

U.S. PATENT DOCUMENTS

| | | | | |
|---|---|---|---|---|
| 10,251,806 | B2 * | 4/2019 | Paterson | A61H 3/04 |
| D865,575 | S * | 11/2019 | Lin | D12/130 |
| 10,695,257 | B2 * | 6/2020 | Paterson | A61H 3/04 |
| 2007/0267835 | A1 * | 11/2007 | Huang | A61H 3/04 280/87.05 |
| 2019/0254895 | A1 * | 8/2019 | Afshani | A61G 5/14 |

* cited by examiner

FULLY FOLDABLE FOUR-WHEEL WALKING AID

TECHNICAL FIELD

The present invention relates to the field of walking aids, and in particular to a fully foldable four-wheel waking aid.

BACKGROUND

At present, China has entered an aging society. With the increase of age, it is a common phenomenon for aged people to be stiff in legs and feet. In addition, patients with fracture, stroke, hemiplegia and other diseases need physical exercises and waking exercises in their rehabilitation stage. Therefore, there is a need for a light, flexile, self-operated walking aid to complete rehabilitation exercises to meet the needs of people.

The existing walking aid often has the following disadvantages: firstly, it is inconvenient that the backrest is pulled out when folding each time and is inserted when using same; secondly, it is easy for the brake cables scattered outside to hook other articles, casing certain risks; and thirdly, when a cushion is used, it is easy for the wheels to slide, and it is easy to roll over during use since the center of gravity of the wheel axle is too high.

In addition, the existing four-wheel waking aid of the same type in the market is relatively complicated in folding structure and large in volume after folding, thus being inconvenient to carry around and bringing a lot of trouble to users.

SUMMARY

To overcome the defects in the prior art, the purpose of the present invert ion is to provide a fully foldable four-wheel walking aid which has the advantages of simple structure and convenient operation, can be fully folded, and is convenient to carry around.

To achieve the above purpose, the present invention adopts the following technical solution:

A fully foldable four-wheel walking aid, comprising a left frame and a right frame which are connected by a connecting frame capable of being folded and unfolded, wherein each of the left frame and the right frame includes a wheel frame, an armrest adjustment frame provided above the wheel frame, a fixed base and a rotary movable base, wherein the fixed base is fixed at the top of the wheel frame, a fixed base groove for placing the rotary movable base is provided in the fixed base, one end of the rotary movable base is connected to the armrest adjustment frame, the other end thereof is placed in the fixed base groove, and the armrest adjustment frame, the rotary movable base and the fixed base are connected by a rotating shaft screw;

a through hole of armrest adjustment frame is provided in the armrest adjustment frame, the rotary movable base is provided with a through hole of rotary movable base, the fixed base is provided with a through hole of fixed base, an open space is formed by the through hole of armrest adjustment frame, the through hole of rotary movable base and the through hole of fixed base, and an elastic pin having recovery capability is provided in the open space;

the connecting frame is provided with a connecting rope, one end of the connecting rope is connected to the upper half of the connecting frame, the other end thereof is connected to a main body of the elastic pin by a connecting column, the connecting column is located below one side of the connecting frame, and the lower half of the armrest adjustment frame is provided with a connecting column sliding through hole for the connecting column to slide upward and downward; and the connecting frame is driven to fold or unfold by an external force, thus driving the connecting rope, the connecting column and the main body of the elastic pin to move upward and downward, so that the main body of the elastic pin is located in a first position and a second position, wherein the first position is: the upper half of the connecting frame is unfolded outward to the maximum unfolding position, the connecting rope is located at the lowest point, the connecting column is located at the bottommost of the connecting column sliding through hole, the main body of the elastic pin is located in the through hole of armrest adjustment frame, the through hole of rotary movable base and the through hole of fixed base, and the rotary movable base is located in the fixed base; and the second position is: the upper half of the connecting frame is folded inward to the maximum folding position, the connecting rope is lifted to the highest point under the driving of the upper half of the connecting frame, the connecting column is located at the uppermost of the connecting column sliding through hole, the main body of the elastic pin is located in the through hole armrest adjustment frame and the through hole of rotary movable base, the rotary movable base is rotatable relative to the fixed base, and the rotary movable base can rotate around the rotating shaft screw.

Further, the elastic pin includes the main body, a spring, and a compression rod, wherein a placing groove for placing the spring and the compression rod and a compression rod sliding through hole for the compression rod to slide upward and downward are provided in the the main body, the compression rod is provided at the top of the spring, the compression rod is connected to the rotary movable base, wherein the first position is: the spring is in the maximum stretching position; and the second position is: the main body and the spring are lifted to the highest point under the driving of the connecting column, and the spring is compressed to the maximum compression position by the compression rod.

Further, a foldable cushion is provided at the top of the connecting frame, and the cushion is provided with a cushion handle.

Further, a hanging column for hanging a shopping bag is provided at one side of the cushion.

Further, hand-push grips are provided at the top of the left frame and the top of the right frame respectively, a front wheel is provided at one end of the wheel frame, and a rear wheel is provided at the other end thereof.

Further, each of the left frame and the right frame is provided with a brake mechanism, the brake mechanism including a brake grip, a brake cable and a brake pad, wherein the brake grip is provided below one side of the hand-push grip; the brake pad is fixed onto the wheel frame and is located above the front wheel; and one end of the brake cable is connected to the brake grip, and the other end thereof is connected to the brake pad through an open space.

Further, the rear wheel is fixed to the wheel frame through a wheel folk fixing base.

Further, the armrest adjustment frame comprises an armrest inner adjustment tube, an armrest outer adjustment tube and an adjustment connecting piece, wherein the armrest inner adjustment tube is sleeved inside the armrest outer adjustment tube, the armrest inner adjustment tube is provided with an inner adjustment through hole adapted to the adjustment connecting piece, the armrest outer adjustment tube is provided with an outer adjustment through hole adapted to the adjustment connecting piece, and the adjustment connecting piece passes through the outer adjustment through hole and the inner adjustment through hole in sequence and then connects the armrest outer adjustment tube and the armrest inner adjustment tube.

Further, the fully foldable four-wheel waking aid further comprises a leaning belt, wherein one end of the leaning belt is connected to the upper half of the left frame, and the other end thereof is connected to the upper half of the right frame.

Further, the connecting frame comprises a first connecting tube and a second connecting tube, wherein the middle part of the first connecting tube is connected with the middle part of the second connecting tube by a rotating shaft to form a cross tube, the lower half of the first connecting tube is connected with a first connecting tube fixing plate, the first connecting tube fixing plate is fixedly connected to the right frame fixing base, the lower half of the second connecting tube is connected with a second connecting tube fixing plate, and the second connecting tube fixing plate is fixedly connected to die fixed base of the left frame.

Compared with the prior art, the present invention has the advantageous effects that: the connecting frame is driven to move upward and downward by an external force, thus driving the connecting rope, the connecting column and the elastic pin to move upward and downward, so that the elastic pin is located in a first position and a second position, wherein the first position is: the upper half of the connecting frame is unfolded outward to the maximum unfolding position, the connecting rope is located at the lowest point, the connecting column is located at the bottommost of the connecting column sliding through hole, the elastic pin is located in the through hob of armrest adjustment frame, the through hob of rotary movable base and the through hole of fixed base, and the rotary movable base is located in the fixed base; and the second position is: the upper half of the connecting frame is folded inward to the maximum folding position, the connecting rope is lifted to the highest point under the driving of the upper half of the connecting frame, the connecting column is located at the uppermost of the connecting column sliding through hole, the elastic pin is located in the through hole of armrest adjustment frame and the through hole of rotary movable base, the rotary movable base is separated from the fixed base, and the rotary movable base can rotate around the rotating shaft screw. In the present invention, by providing with the elastic pin, the connecting frame drives the connecting column to lift upward in the process of folding inward, thus driving the elastic pin to lift upward, so that the elastic pin is located in the through hole of armrest adjustment frame and the through hole of rotary movable base. At this time, the rotary movable base is separated from the fixed base, the user swings the armrest adjustment frame backward, and the rotary movable base rotates backward with the rotary shaft screw as the axis, thereby completing the overall folding; The fully foldable four-wheel waking aid has the advantages of simple structure and convenient operation, can be fully folded, and is convenient to carry around.

DESCRIPTION OF DRAWINGS

The specific embodiments of the present invention will be further deserted below in detail in conjunction with the accompanying drawings, in which.

Figure 1:
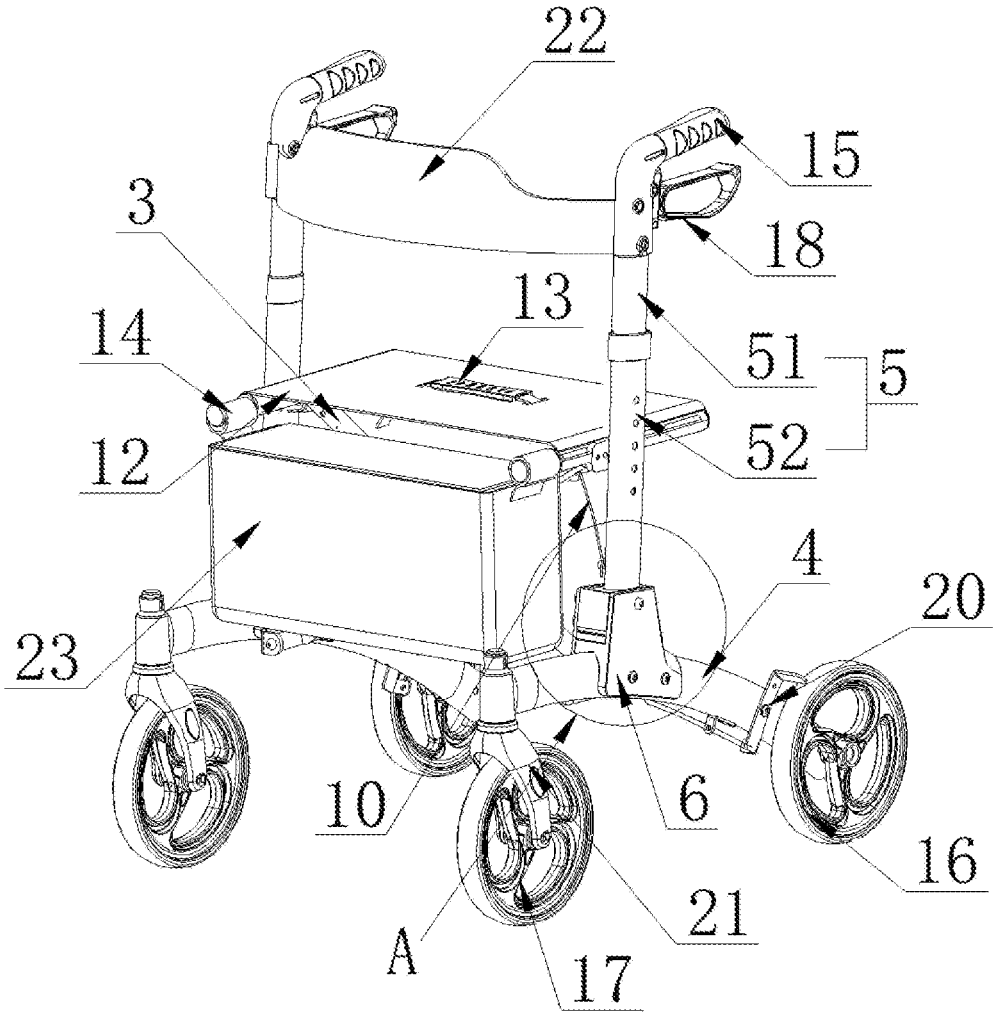
FIG. 1 is a structural schematic diagram of the present invention.
Figure 2:
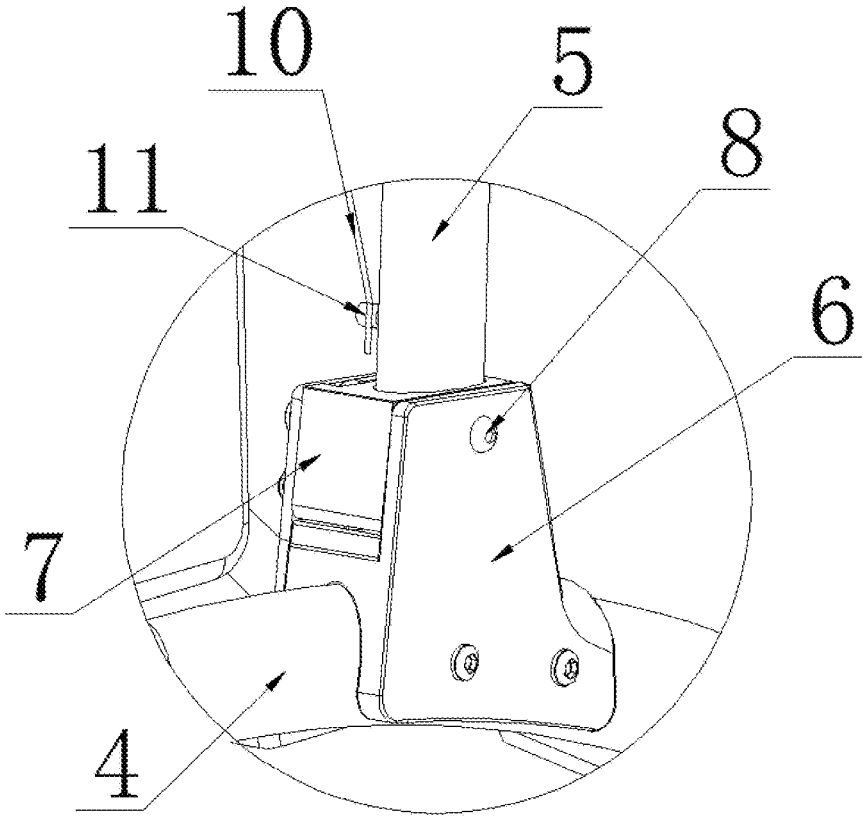
FIG. 2 is a local enlarged view of area A in FIG. 1.

In the figures: 1—left frame; 2—right frame; 3—connecting frame; 4—wheel frame; 5—armrest adjustment frame; 6—fixed base; 7—rotary movable base; 8—rotating shaft screw; 9—elastic pin; 10—connecting rope; 11—connecting column; 12—cushion; 13—cushion handle; 14—hanging column; 15—hand-push grip; 16—front wheel; 17—rear wheel; 18—brake grip; 19—brake cable; 20—brake pad; 21—fork fixing base; 22—leaning belt; 31—first connecting tube; 32—second connecting tube; 33—first connecting frame fixing base; 34—second connecting frame fixing base; 35—first connecting frame; 36—second connecting frame; 51—armrest inner adjustment tube; 52—armrest outer adjustment tube; 91—pin; 92—spring; 93—compression rod; 311—first connecting tube fixing plate; 321—second connecting tube fixing plate.

DETAILED DESCRIPTION

Preferred embodiments of the present invention will be explained below in detail in combination with drawings. It should be understood that the preferred embodiments described below are only used for describing and explaining the present invention, but are not used for limiting the present invention.

It should be noted in the description of the present invention that terms such as "central", "upper", "lower", "left", "right", "vertical", "horizontal", "inner", "outer", etc. indicate direction or position relationships shown based on the drawings, and are only intended to facilitate the description of the present invention and the simplification of the description rather than to indicate or imply that the indicated device or element must have a specific direction or constructed and operated in a specific direction, and therefore, shall not be understood as a limitation to the present invention. In addition, the terms such as "first", "second" and "third" are only used for the purpose of description, rather than being understood to indicate or imply relative importance.

It should be noted in the explanation of the present invention that, unless otherwise specifically regulated and defined, terms such as "installation," "connected," and "connecting" shall be understood in broad sense, and for example, may refer to fixed connection or detachable connection or integral connection, may refer to mechanical connection or electrical connection, and may refer to direct connection or indirect connection through an intermediate medium or inner communication of two elements. For those ordinary skilled in the art, the meanings of die above terms in the present invention may be understood according to specific conditions.

As shown in FIGS. 1-7, a fully foldable four-wheel waking aid, comprising a left frame 1 and a right flame 2, wherein the left frame 1 and the right frame 2 are connected by a connecting frame 3 capable of being folded and unfolded. Preferably, the left frame 1 in this embodiment is completely identical to the right frame 2 in structure.

Specifically, each of the left frame 1 and the right frame 2 includes a wheel frame 4, an armrest adjustment frame 5 provided above the wheel frame 4, a fixed base 6 and a rotary movable base 7, wherein the fixed base 6 is fixed at the top of the wheel frame 4, a fixed base groove for placing the rotary movable base 7 is provided in the fixed base 6, one end of the rotary movable base 7 is connected to the armrest adjustment frame 5, the other end thereof is placed in the fixed base groove, and the armrest adjustment frame 5, the rotary movable base 7 and the fixed base 6 are connected by a rotating shaft screw 8.

Specifically, a through hole of armrest adjustment frame is provided in the armrest adjustment frame 5, the rotary movable base 7 is provided with a through hole of rotary movable base, the fixed base 6 is provided with a through hole of fixed base, an (yen space is formed by the through hole of armrest adjustment frame, the through hole of rotary movable base and the through hole of fixed base, and an elastic pin 9 having recovery capability is provided in the open space.

Specifically, the connecting frame 3 is provided with a connecting rope 10, one end of the connecting rope 10 is connected to the upper half of the connecting frame 3, the other end thereof is connected to the elastic pin 9 by a connecting column 11, the connecting column 11 is located below one side of the connecting frame 3, and the lower half of the armrest adjustment frame 5 is provided with a connecting column sliding through hole for the connecting column 11 to slide upward and downward.

Specifically, the connecting frame 3 is driven to be fold or unfold by an external force, thus driving the connecting rope 10, the connecting column 11 and the elastic pin 9 to move upward and downward, so that the elastic pin 9 is located in a first position and a second position, wherein the first position is: the upper half of the connecting frame 3 is unfolded outward to the maximum unfolding position, the connecting rope 10 is located at the lowest point, the connecting column 11 is located at the bottommost of the connecting column sliding through hole, the elastic pin 9 is located in the through hole of armrest adjustment frame, the through hole of rotary movable base and the through hole of fixed base, and the rotary movable base 7 is heated in the fixed base 6; and the second position is: the upper half of the connecting frame 3 is folded inward to the maximum folding position, the connecting rope 10 is lifted to the highest point under the driving of the upper half of the connecting frame 3, the connecting column 11 is located at the uppermost of the connecting column sliding through hole, the elastic pin 9 is located in the through hole of armrest adjustment frame and the through hole of rotary movable base, the rotary movable base 7 is separated from the fixed base 6, and the rotary movable base 7 can rotate around the rotating shaft screw 8.

Figure 8:
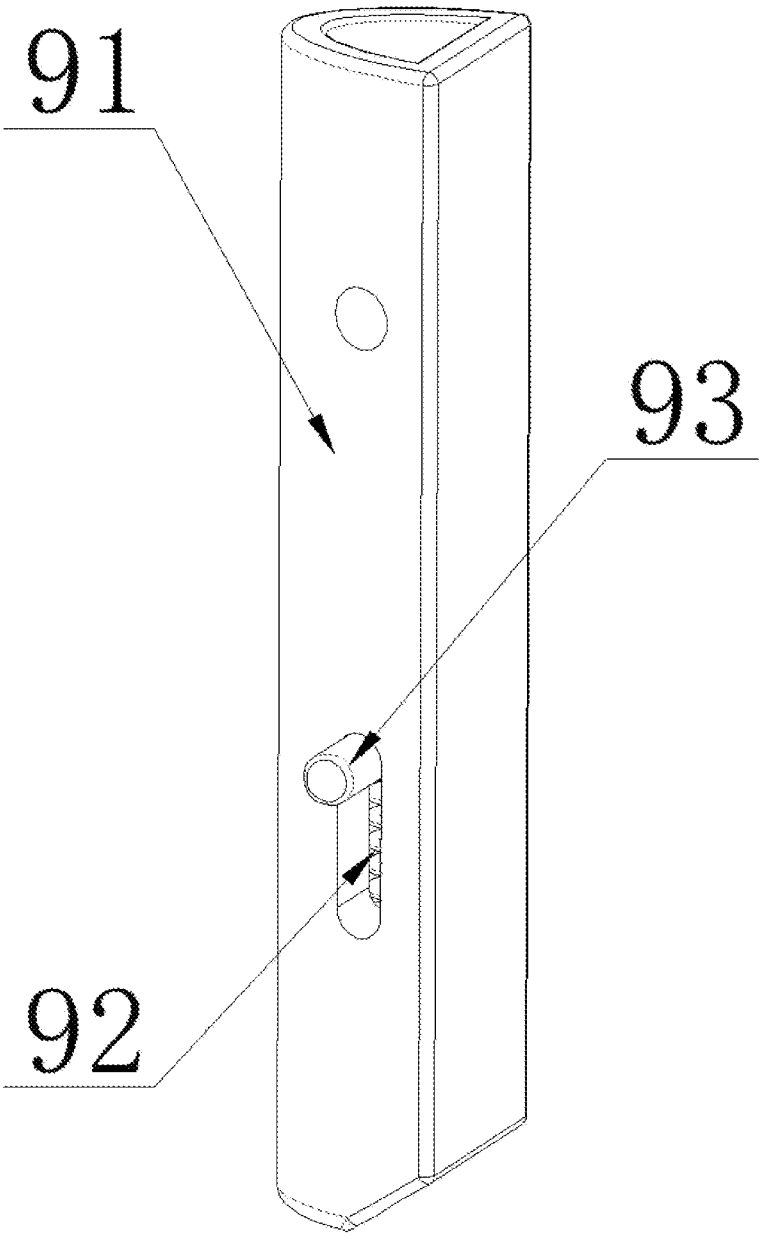
FIG. 8 is a structural schematic diagram of the elastic pin of the present invention.

As shown in FIG. 8, the elastic pin 9 includes a main body 91, a spring 92, and a compression rod 93, wherein a placing groove for placing the spring 92 and the compression rod 93 and a compression rod sliding through hole for the compression rod 93 to slide upward and downward are provided in the main body 91, the compression rod 93 is provided at the top of the spring 92, the rotary movable base 7 is provided with a first through hole of movable base and a second through hole of movable base, one end of the compression rod 93 is connected to the first through hole of movable base, and the other end thereof is connected to the second through hole of movable base, wherein the first position is: the spring 92 is in the maximum stretching position, and the compression rod 93 is located at the top of the spring 92; and the second position is: the main body 91 and the spring 92 are lifted to the highest point under the driving of the connecting column 11, and the spring 92 is compressed to the maximum compression position by the compression rod 93.

Preferably, when the elastic pin 9 is installed, the spring 92 and the compression rod 93 are placed in the placing groove first, then one end of the compression rod 93 is connected to the first through hole of movable base, and the other end thereof is connected to the second through hole of movable base. When the main body 91 is pulled upward by an external force, since one end of the compression rod 93 is connected to the first through hole of movable base and the other end thereof is connected to the second through hole of movable base, during the ascending process of the main body 91, the compression rod 93 may squeeze the spring 92, causing the spring 92 to deform. When the external force disappears, the spring 92 is reset. The main body 91 moves downward under the spring force of the spring 92 to tightly clamp the rotary movable base 7 and the fixed base 6, so that the rotary movable base 7 cannot rotate.

Specifically, a foldable cushion 12 is provided at the top of the connecting frame 3, and the cushion 12 is provided with a cushion handle 13.

Specifically, a hanging column 14 for hanging a shopping bag 23 is provided at one side of the cushion 12. Preferably, two hanging columns 14 are provided.

Specifically, hand-push grips 15 are provided at the top of the left frame 1 and the top of the right frame 2 respectively, a front wheel 16 is provided at one end of the wheel frame 4, and a rear wheel 17 is provided at the other end thereof. Preferably, the rear wheel 17 is fixed to the wheel frame 4 through a wheel folk fixing base 21.

Specifically, each of the left frame 1 and the right frame 2 is provided with a brake mechanism, the brake mechanism including a brake grip 18, a brake cable 19 and a brake pad 20, wherein the brake grip 18 is provided below one side of the hand-push grip 15; the brake pad 20 is fixed onto the wheel frame 4 and is located above the front wheel 16; one end of the brake cable 19 is connected to the brake grip 18, and the other end thereof is connected to the brake pad 20 through an open space. Preferably, the brake cable 19 is partially provided in the open space, which can prevent the brake cable 19 from being exposed, and thus better protecting the brake cable 19.

Specifically, the armrest adjustment frame 5 comprises an armrest inner adjustment tube 51, an armrest outer adjustment tube 52 and an adjustment connecting piece, wherein the armrest inner adjustment tube 51 is sleeved inside the armrest outer adjustment tube 52, the armrest inner adjustment tube 51 is provided with an inner adjustment through hole adapted to the adjustment connecting piece, the armrest outer adjustment tube 52 is provided with an outer adjustment through hole adapted to the adjustment connecting piece, and the adjustment connecting piece passes through the outer adjustment through hole and the inner adjustment through hole in sequence and then connects the armrest outer adjustment tube 52 and the armrest inner adjustment tube 51. Preferably, a plurality of outer adjustment through holes are provided.

Preferably, the armrest adjustment frame 5 can be adjusted in height according to the user's needs. When the armrest adjustment frame 5 needs to be adjusted, there in only a need to unscrew and take out the adjustment connecting piece and then upward or downward the armrest inner adjustment tube 51. When reaching the height the user waits, the adjustment connecting piece is inserted into the outer adjustment through hole and the inner adjustment through hole to fix the armrest outer adjustment tube 52 and the armrest inner adjustment tube 51.

Specifically, this embodiment further comprises a leaning belt 22, wherein one end of the leaning belt 22 is connected to the upper half of the left frame 1, and the other end thereof is connected to the upper half of the right frame 2.

Specifically, the left frame 1 includes a first wheel frame, a first armrest adjustment frame provided above first wheel frame, a first fixed base and a first rotary movable base, wherein the first fixed base is fixed at the top of the first wheel frame, a first fixed base groove for placing the first rotary movable base is provided in the first fixed base, one end of the first rotary movable base is connected to the first armrest adjustment frame, the other end thereof is placed in the first fixed base groove, and the first armrest adjustment frame, the first rotary movable base and the first fixed base are connected by a first rotating shaft screw.

Specifically a through hole of first armrest adjustment frame is provided in the first armrest adjustment frame, the first rotary movable base is provided with a through hole of first rotary movable base, the first fixed base is provided with a through hole of first fixed base, a first open space is formed by the through hole of first armrest adjustment frame, the through hole of first rotary movable base and the through hob of first fixed base, and a first elastic pin having recovery capability is provided in the first open space.

Specifically, the right frame 2 includes a second wheel frame, a second armrest adjustment frame provided above second wheel frame, a second fixed base and a second rotary movable base, wherein the second fixed base is fixed at the top of the second wheel frame, a second fixed base groove for placing the second rotary movable base is provided in the second fixed base, one end of the second rotary movable base is connected to the second armrest adjustment frame, the other end thereof is placed in the second fixed base groove, and the second armrest adjustment frame, the second rotary movable base and the second fixed base are connected by a second rotating shaft screw.

Specifically a through hole of second armrest adjustment frame is provided in the second armrest adjustment frame, the second rotary movable base is provided with a through hole of second rotary movable base, the second fixed base is provided with a through hole of second fixed base, a second open space is formed by the through hole of second armrest adjustment frame, the through hole of second rotary movable base and the through hole of second fixed base, and a second elastic pin having recovery capability is provided in the second open space.

Specifically, the connecting frame 3 is a cross connecting frame. The connecting frame 3 comprises a first connecting tube 31 and a second connecting tube 32, wherein the middle part of the first connecting tube 31 is connected with the middle part of the second connecting tube 32 by a rotating shaft to form a cross tube, the lower half of the first connecting tube 31 is connected with a first connecting tube fixing plate 311, the first connecting tube fixing plate 311 is fixedly connected to the fixed base 6 of the right frame 2, the tower half of the second connecting tube 32 is connected with a second connecting tube fixing plate 321, and the second connecting tube fixing plate 321 is fixedly connected to the fixed base 6 of the left frame 1.

Specifically, a first connecting frame fixing base 33 is fixed in the middle of the first armrest adjustment frame, a second connecting frame fixing base 34 is fixed in the middle of the second armrest adjustment frame, the upper half of the first connecting tube 31 is provided with a first connecting frame 35, the upper half of the second connecting tube 32 is provided with a second connecting frame 36, one end of die first connecting frame 35 is connected to the first connecting frame fixing base 33, the other thereof is connected to the upper half of the first connecting tube 31, one end of the second connecting frame 36 is connected to the second connecting frame fixing base 34, and the other end thereof is connected to the upper half of the second connecting tube 32.

Specifically, the connecting rope 10 includes a first connecting rope and a second connecting rope, and the connecting column 11 includes a first connecting column and a second connecting column, wherein one end of the first connecting rope is connected to the first connecting frame 35, the other end thereof is connected to the first elastic pin through the first connecting column; one end of the second connecting rope is connected to the second connecting frame 36, and the other end thereof is connected to the second elastic pin through the second connecting column.

Figure 3:
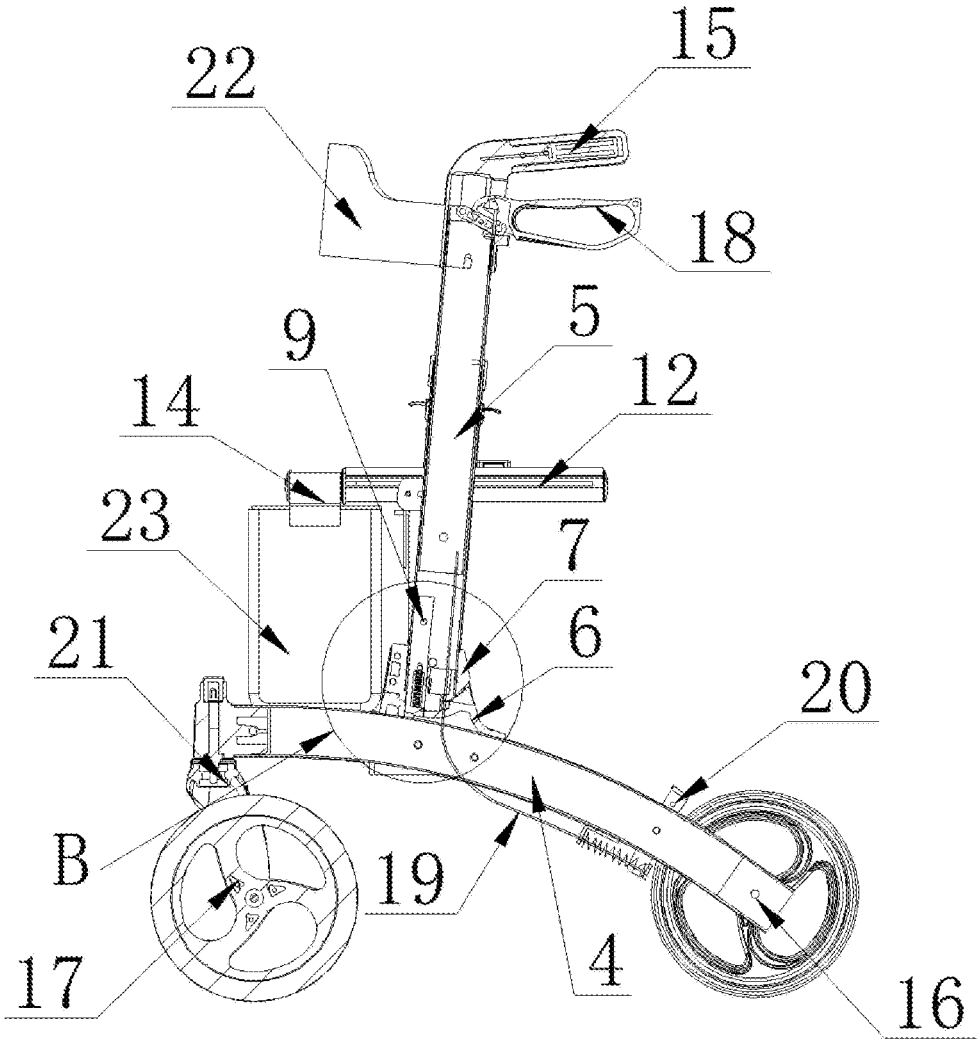
FIG. 3 is aside view of the present invert ion.
Figure 4:
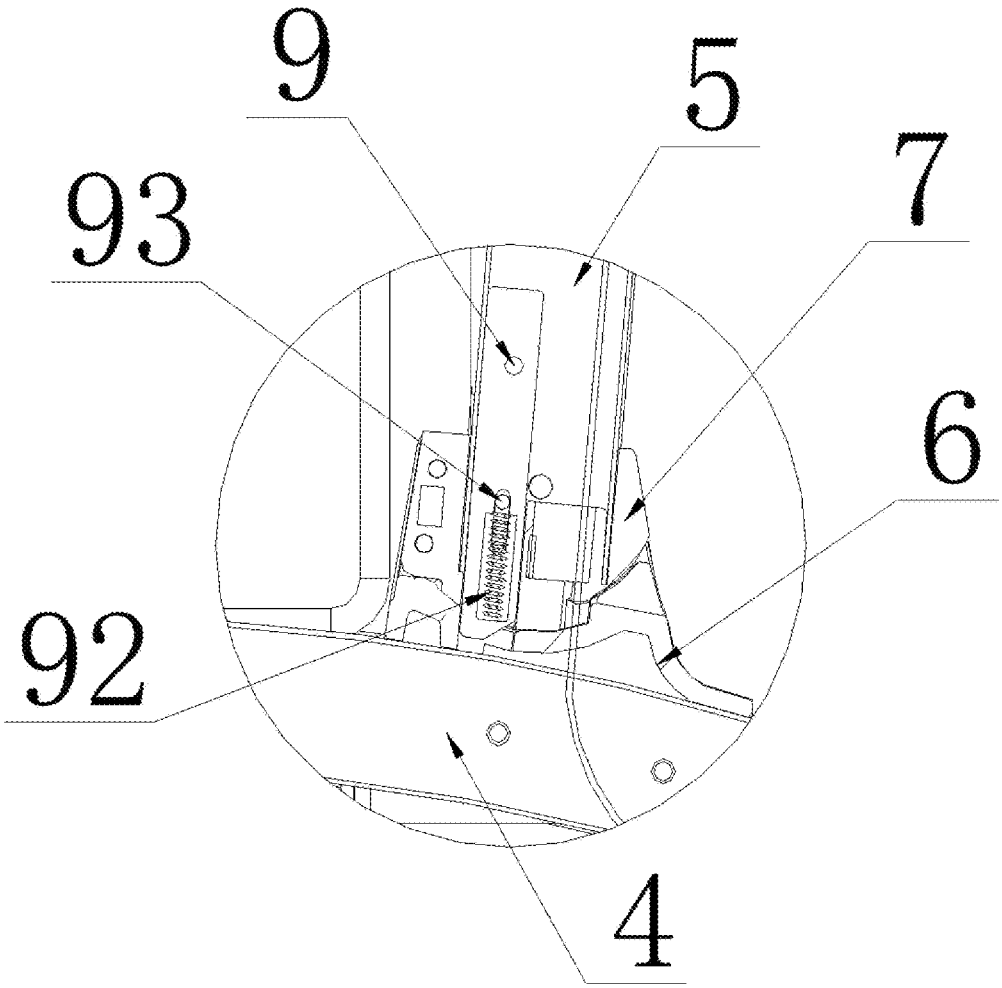
FIG. 4 is a local enlarged view of area B in FIG. 3.
Figure 5:
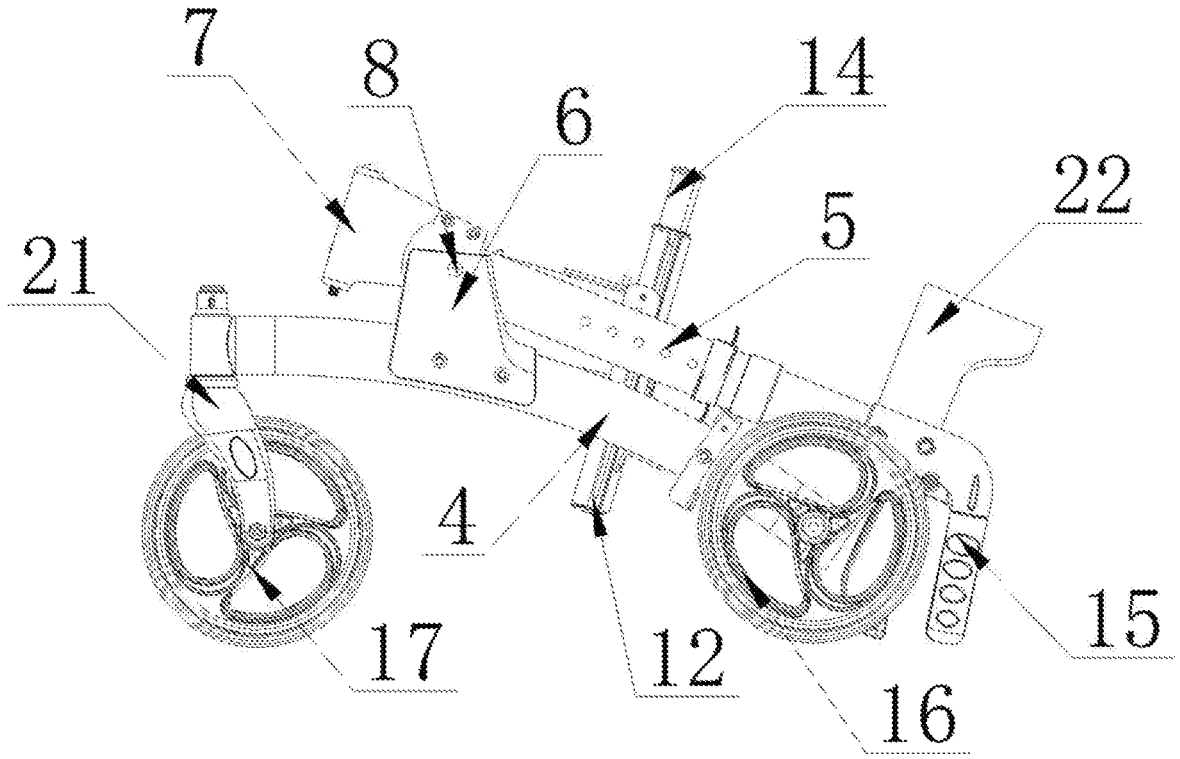
FIG. 5 is a side view of the present invention in a folding slate.
Figure 6:
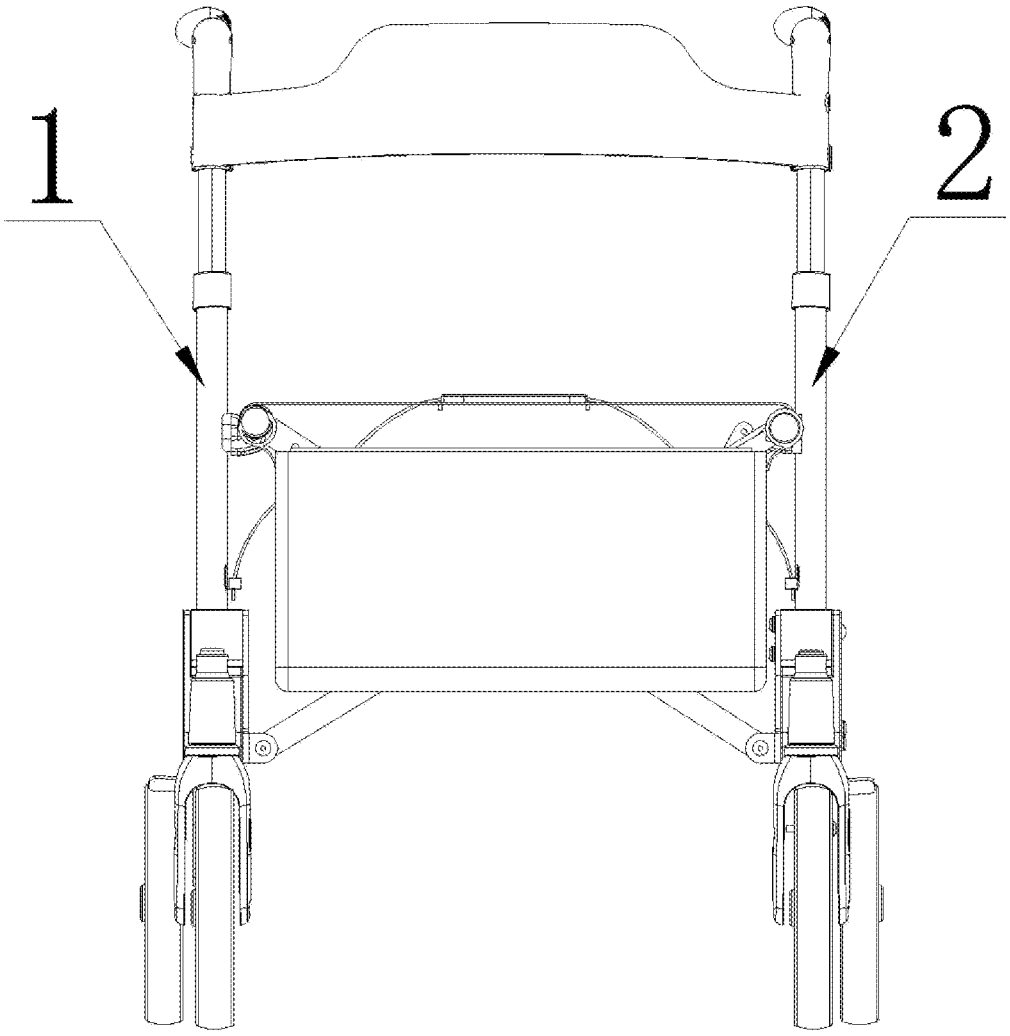
FIG. 6 is a rear view of the present invention.
Figure 7:
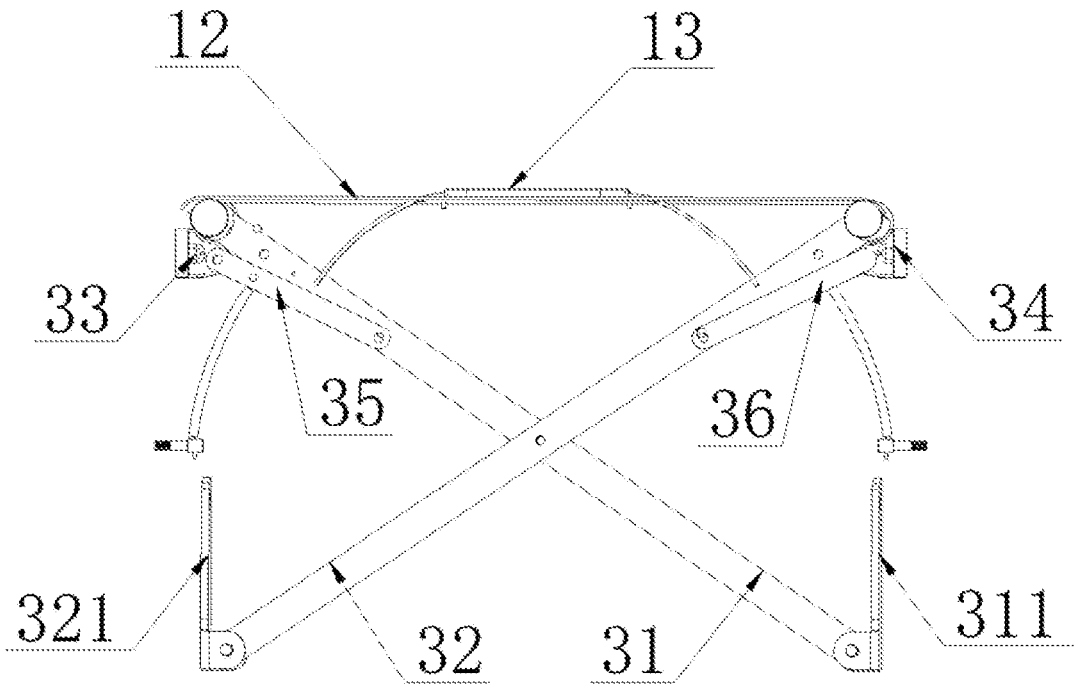
FIG. 7 is a structural schematic diagram of the connecting frame and the cushion of die present invention.

This embodiment has the working principle that:

The state diagram of this embodiment under normal use is as shown in FIG. 3. Because the first elastic pin tightly clamps the first rotary movable base and the first fixed base, and the second elastic pin tightly clamps the second rotary movable base and the second fixed base, the first rotary movable base cannot be folded over; as shown in FIG. 4, when there is a need to fold this embodiment, the user only needs to pull the cushion handle 13 upward, the cushion 12 and the connecting frame 3 are folded inward under the action of the pulling force, during the process of folding the first connecting tube 31 and the second connecting tube 32 inward, the first connecting column and the second connecting column are driven to lift upward, thus driving the first elastic pin and the second elastic pin to lift upward, so that the first elastic pin is respectively located in the through hole of first armrest adjustment frame and the through hole of first rotary movable base; at this moment, the first rotary movable base is separated from the first fixed base, and the second elastic pin is located in the through hole of second armrest adjustment frame and the through hole of second rotary movable base; at this moment, the second rotary movable base is separated from the second fixed base, the user rotates the first armrest adjustment frame and the second armrest adjustment frame backwards, the first rotary movable base rotates backward with the first rotating shaft screw as the axis, and the second rotary movable base rotates backward with the second rotating shaft screw as the axis, thereby completing the overall folding.

For those skilled in the art, various other corresponding changes and modifications can be made according to the technical solution and concept described above, and all these changes and modifications should foil within the protection scope of the claims of the present invention.

The invention claimed is:

1. A fully foldable four-wheel walking aid, comprising a left frame and a right frame which are connected by a connecting frame capable of being folded and unfolded, wherein each of the left frame and the right frame includes a wheel frame, an armrest adjustment frame provided above the wheel frame, a fixed base and a rotary movable base, wherein the fixed base is fixed at the top of the wheel frame, a fixed base groove for placing the rotary movable base is provided in the fixed base, one end of the rotary movable base is connected to the armrest adjustment frame, the other end thereof is placed in the fixed base groove, and the armrest adjustment frame, the rotary movable base and the fixed base are connected by a rotating shaft screw;

a through hole of armrest adjustment frame is provided in the armrest adjustment frame, the rotary movable base is provided with a through hole of rotary movable base, the fixed base is provided with a through hole of fixed base, an open space is formed by the through hole of armrest adjustment frame, the through hole of rotary movable base and the through hole of fixed base, and an elastic pin having recovery capability is provided in the open space;

the connecting frame is provided with a connecting rope, one end of the connecting rope is connected to the upper half of the connecting frame, the other end thereof is connected to a main body of the elastic pin by a connecting column, the connecting column is located below one side of the connecting frame, and the lower half of the armrest adjustment frame is provided with a connecting column sliding through hole for the connecting column to slide upward and downward; and the connecting frame is driven to fold or unfold by an external force, thus driving the connecting rope, the connecting column and the main body of the elastic pin to move upward and downward, so that the main body of the elastic pin is located in a first position and a second position, wherein the first position is: the upper half of the connecting frame is unfolded outward to the maximum unfolding position, the connecting rope is located at the lowest point, the connecting column is located at the bottommost of the connecting column sliding through hole, the main body of the elastic pin is located in the through hole of armrest adjustment frame, the through hole of rotary movable base and the through hole of fixed base, and the rotary movable base is located in the fixed base; and the second position is: the upper half of the connecting frame is folded inward to the maximum folding position, the connecting rope is lifted to the highest point under the driving of the upper half of the connecting frame, the connecting column is located at the uppermost of the connecting column sliding through hole, the main body of the elastic pin is located in the through hole of armrest adjustment frame and the through hole of rotary movable base, the rotary movable base is rotatable relative to the fixed base, and the rotary movable base can rotate around the rotating shaft screw.

2. The fully foldable four-wheel walking aid according to claim 1, wherein the elastic pin includes the main body, a spring, and a compression rod, wherein a placing groove for placing the spring and the compression rod and a compression rod sliding through hole for the compression rod to slide upward and downward are provided in the main body, the compression rod is provided at the top of the spring, the compression rod is connected to the rotary movable base, wherein the first position is: the spring is in the maximum stretching position; and the second position is: the main body and the spring are lifted to the highest point under the driving of the connecting column, and the spring is compressed to the maximum compression position by the compression rod.

3. The fully foldable four-wheel walking aid according to claim 1, wherein a foldable cushion is provided at the top of the connecting frame, and the cushion is provided with a cushion handle.

4. The fully foldable four-wheel walking aid according to claim 3, wherein a hanging column for hanging a shopping bag is provided at one side of the cushion.

5. The fully foldable four-wheel walking aid according to claim 1, wherein hand-push grips are provided at the top of the left frame and the top of the right frame respectively, a front wheel is provided at one end of the wheel frame, and a rear wheel is provided at the other end thereof.

6. The fully foldable four-wheel walking aid according to claim 5, wherein each of the left frame and the right frame is provided with a brake mechanism, the brake mechanism including a brake grip, a brake cable and a brake pad, wherein the brake grip is provided below one side of the hand-push grip; the brake pad is fixed onto the wheel frame and is located above the front wheel; and one end of the brake cable is connected to the brake grip, and the other end thereof is connected to the brake pad through an open space.

7. The fully foldable four-wheel walking aid according to claim 5, wherein the rear wheel is fixed to the wheel frame through a wheel fork fixing base.

8. The fully foldable four-wheel walking aid according to claim 1, wherein the armrest adjustment frame comprises an armrest inner adjustment tube, an armrest outer adjustment tube and an adjustment connecting piece, wherein the armrest inner adjustment tube is sleeved inside the armrest outer adjustment tube, the armrest inner adjustment tube is provided with an inner adjustment through hole adapted to the adjustment connecting piece, the armrest outer adjustment tube is provided with an outer adjustment through hole adapted to the adjustment connecting piece, and the adjustment connecting piece passes through the outer adjustment through hole and the inner adjustment through hole in sequence and then connects the armrest outer adjustment tube and the armrest inner adjustment tube.

9. The fully foldable four-wheel walking aid according to claim 1, further comprising a leaning belt, wherein one end of the leaning belt is connected to the upper half of the left frame, and the other end thereof is connected to the upper half of the right frame.

10. The fully foldable four-wheel walking aid according to claim 1, wherein the connecting frame comprises a first connecting tube and a second connecting tube, wherein the middle part of the first connecting tube is connected with the middle part of the second connecting tube by a rotating shaft to form a cross tube, the lower half of the first connecting tube is connected with a first connecting tube fixing plate, the first connecting tube fixing plate is fixedly connected to the fixed base of the right frame, the lower half of the second connecting tube is connected with a second connecting tube fixing plate, and the second connecting tube fixing plate is fixedly connected to the fixed base of the left frame.

* * * * *